US009291077B2

(12) United States Patent
Traversa

(10) Patent No.: US 9,291,077 B2
(45) Date of Patent: Mar. 22, 2016

(54) OPERATION CONTROL SYSTEM FOR A SOLENOID VALVE OF A COMBUSTION ENGINE AND METHOD

(71) Applicant: Schaeffler Technologies AG & Co. KG, Herzogenaurach (DE)

(72) Inventor: Piergiacomo Traversa, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 368 days.

(21) Appl. No.: 13/845,473

(22) Filed: Mar. 18, 2013

(65) Prior Publication Data

US 2013/0284131 A1 Oct. 31, 2013

Related U.S. Application Data

(60) Provisional application No. 61/639,277, filed on Apr. 27, 2012.

(51) Int. Cl.

| | |
|---|---|
| ***F01L 1/00*** | (2006.01) |
| ***F01L 9/04*** | (2006.01) |
| ***H01F 7/18*** | (2006.01) |
| *F01L 9/02* | (2006.01) |

(52) U.S. Cl.

CPC ..... *F01L 9/04* (2013.01); *H01F 7/1844* (2013.01); *F01L 9/02* (2013.01)

(58) Field of Classification Search

CPC ..... F01L 9/02; F01L 9/021
USPC ..... 123/90.1, 90.12, 90.14, 90.16, 123/90.24–90.26, 321–348
See application file for complete search history.

(56) References Cited

U.S. PATENT DOCUMENTS

| | | | | |
|---|---|---|---|---|
| 5,163,316 | A * | 11/1992 | Toyoda et al. | 73/114.69 |
| 5,193,494 | A * | 3/1993 | Sono et al. | 123/90.12 |
| 5,678,521 | A * | 10/1997 | Thompson et al. | 123/447 |
| 7,035,728 | B2 * | 4/2006 | Manzone | F02D 41/20 701/103 |
| 7,954,464 | B2 | 6/2011 | Proschko | |
| 2004/0237935 | A1 * | 12/2004 | Fukusako et al. | 123/406.47 |
| 2009/0064950 | A1 * | 3/2009 | Rayl | F01L 1/185 123/90.15 |
| 2009/0064951 | A1 * | 3/2009 | Rayl | F01L 1/185 123/90.15 |
| 2009/0070016 | A1 * | 3/2009 | Rayl | F01L 1/185 701/105 |

FOREIGN PATENT DOCUMENTS

| | | |
|---|---|---|
| DE | 10324807 | 12/2004 |

* cited by examiner

*Primary Examiner* — John Kwon
(74) *Attorney, Agent, or Firm* — Volpe and Koenig, P.C.

(57) ABSTRACT

An operation control system for a solenoid valve of a combustion engine having at least one solenoid valve to hydraulically couple and decouple actuation forces of a cam with a gas valve of a cylinder. A driving unit operates the solenoid valve, and a first detection device monitors a status of the solenoid valve by supplying a status signal to a control unit during an engine intake cycle phase of the cylinder. A second detection device analyzing a system parameter corresponding to the cylinder and supplying a control signal during an engine cycle phase other than the engine intake cycle phase. The control unit delays the status signal based on the status signal to temporally synchronize the status signal with the control signal, or a secondary control signal based thereon, and compares the status signal with the control signal or the secondary signals with each other using an AND-Function.

8 Claims, 5 Drawing Sheets

Fig. 4

Table 1

| Monitor Strategy Description | Malfunction criteria | Threshold value | Parameters | Enable Conditions | Time Required | MIL illumination |
|---|---|---|---|---|---|---|
| Measure the current feedback delta from the Switch On to Peak Margin end. When the delta is too low, no 'V' shape is recognized. | Solenoid Valve Switch On Time Status | = 5 (V-shape was not recognized) | Engine Running | = True | < 3000 rpm, = 99 Valve commands (0.99 sec at 2999 rpm) | 1 trip MIL |
| | | | Solenoid valve coil temperature model | > 20 °C < 150 °C | | |
| | | | Battery Voltage | >= 11.0 V <= 15.0 V | | |
| | | | Battery Voltage Fault Active (P0560) | = False | > 3000 rpm, = 198 Valve commands (0.86 sec at 6900 rpm and 1.98 sec at 750 rpm) | |
| | | | ASD Main Control Relay | = Closed | | |
| | | | ASD Main Control Circuit Fault Active (P0685) | = False | | |
| | | | Oil Aeration | = False | | |

OPERATION CONTROL SYSTEM FOR A SOLENOID VALVE OF A COMBUSTION ENGINE AND METHOD

INCORPORATION BY REFERENCE

The following documents are incorporated herein by reference as if fully set forth: U.S. Provisional Application No. 61/639,277, filed Apr. 27, 2012.

BACKGROUND

Hydraulic valve actuation systems have been employed to reduce fuel consumption in the last years. They use solenoid valves to couple a high pressure chamber with a lower pressure chamber. When the solenoid valve is open the actuation of the cams is not transmitted to the gas valves but simply circulates the hydraulic fluid in the hydraulic system. When the solenoid valve is closed the chambers are separated from each other establishing a hydraulic coupling between the camshaft and the gas exchange valves.

U.S. Pat. No. 7,954,464 discloses an electro-hydraulically controlled gas exchange valve actuation system. FIGS. 1, 3 and 5 of this patent are reproduced, with minor changes herein as prior art FIGS. 5, 6 and 7 in order to illustrate the known components typically found in the cylinder head of an internal combustion engine with such valve actuation systems. In FIG. 5, a cylinder head 11 of an internal combustion engine is shown having a top 12, under which an electrohydraulic valve control unit 13 is located having a plurality of electrically controllable hydraulic valves 14, which are preferably solenoid valves. The hydraulic medium filling port 15 and filling device 16 are also shown along with an end of the camshaft 17. A cylinder 18 associated with one set of valves is also indicated FIG. 6 is a detail from U.S. Pat. No. 7,954,464 showing the master unit 22 which includes a cam follower 24 supported in an articulated manner on a rigid support element 23 with a roller bearing-supported roller 25 as the cam pick-up surface and also a spring-loaded pump piston 26, which is driven by the cam follower 24 and which limits a variable volume pressure space 27. The lower housing part 19 is constructed as a pressure-sealed, forged part made from aluminum. For an opened hydraulic valve 14, the pressure space 27 is connected to a pressure relief space 28, which is limited, on its side, by a spring force-loaded piston 29 of a pressurized storage device 30. A sensor 31 screwed into the lower housing part 19 is used for detecting the hydraulic medium temperature.

Prior art FIG. 7 shows the hydraulic valve 14, which is also arranged offset to the associated master unit 22 and slave unit 34 in the longitudinal direction of the hydraulic unit 13. The slave unit is shown acting on a gas exchange valve 35, whose stem contacts the slave unit 34. The channel 32 is connected to another channel hydraulically by an annular groove 39 running on the hydraulic valve 14, so that the annular groove 39, just like the connected channels, is a component of the pressure space 27. In the opened state, the hydraulic valve 14 permits an overflow of hydraulic medium from the pressure space 27 into the pressure relief space 28 and back via a borehole 40 connecting the pressure relief space 28 to the annular groove 39.

Sometimes the solenoid valves get stuck and cause misfire in the engine. This may happen if they get stuck in the closed or the open position. There are control circuits that check upon the electric current in the coil of the solenoid valves and evaluate whether the valve got stuck or not. This usually takes a long time exceeding several engine cycles and impairs the overall performance. When trying to reduce the malicious effects the detection becomes unreliable.

In DE 103 24 807 A1 the main idea is the detection of misfire, but also a statement regarding the solenoid valves could be made since the respective signals are combined in an AND-comparator. The problem is that not all known misfire detection methods are combinable with this teaching, which also does not allow to further improve the certainty of the prediction.

SUMMARY

One objective is to improve the certainty of the detection of a stuck solenoid valves, such as the solenoid valves in U.S. Pat. No. 7,954,464 discussed above.

Another objective is to also foster the employment of other misfire detection methods and to link them to the control signal of the solenoid valves.

The objectives are met with an operation control system for a solenoid valve of a combustion engine including:

A) At least one solenoid valve adapted to hydraulically couple and decouple the actuation force of a cam with a gas valve of a cylinder in the combustion engine. A high pressure chamber, which is intended to transmit the hydraulic actuation force, communicates with a cam of the camshaft of the engine and also communicates with the gas valve, which may be an intake or an exhaust valve. The solenoid valve opens to connect the high pressure chamber with another low pressure chamber and thereby reducing the pressure in the high pressure chamber in order to decouple the hydraulic actuation from the gas valve.

B) A driving unit to run the solenoid valve, which may contain various driving and control circuits.

C) A first detection device monitoring the status of the solenoid valve by supplying a status signal to a control unit during an engine intake cycle phase of the cylinder. This signal can be derived from a steering signal of the solenoid valve or may be detected with a detector, such as an ampmeter or other electric current measuring device.

D) A second detection device analyzing a system parameter corresponding to the cylinder and supplying a control signal during an engine cycle phase other than the engine intake cycle phase. Such parameter might be a camshaft instantaneous angular velocity, which applies during the time the cylinder should have an effect on the crankshaft. Alternatively the ionization current in the combustion chamber could be measured and used as a control signal. Alternatively it is used to generate a secondary signal, which is a function of the control signal in order to condition the signal for further processing using the AND-comparison. The control unit delays the status signal or a secondary status signal based on the status signal to temporally synchronize the status signal with the control signal or synchronize the secondary status signal with the secondary control signal, the secondary control signal being based on the control signal. Furthermore it compares the status signal with the control signal or the secondary signals with each other using an AND-Function. The secondary signals carry the same information like the control and status signal. However, the secondary signals are more adequate to be processed in the comparator or other binary logic components.

The invention further includes the method with the steps A, B, C and D.

Depending on the type of measurement used, the respective control signal may be generated during the engine cycle expansion phase, the engine cycle discharge phase or the engine cycle compression phase of the cylinder. All such time discrepancies can be compensated for by the invention.

Another embodiment generates the delay using an electronic component and/or a computer operation system running the control unit. The electronic component represents the more robust solution, whereas the Software option is easier to change and implement when the various misfire detection techniques need to remain possible options.

BRIEF DESCRIPTION OF THE DRAWINGS

FIG. 4 shows Table 1 with typical parameters and criteria for the status signal SSV analysis.

DETAILED DESCRIPTION OF THE PREFERRED EMBODIMENT

Figure 1:
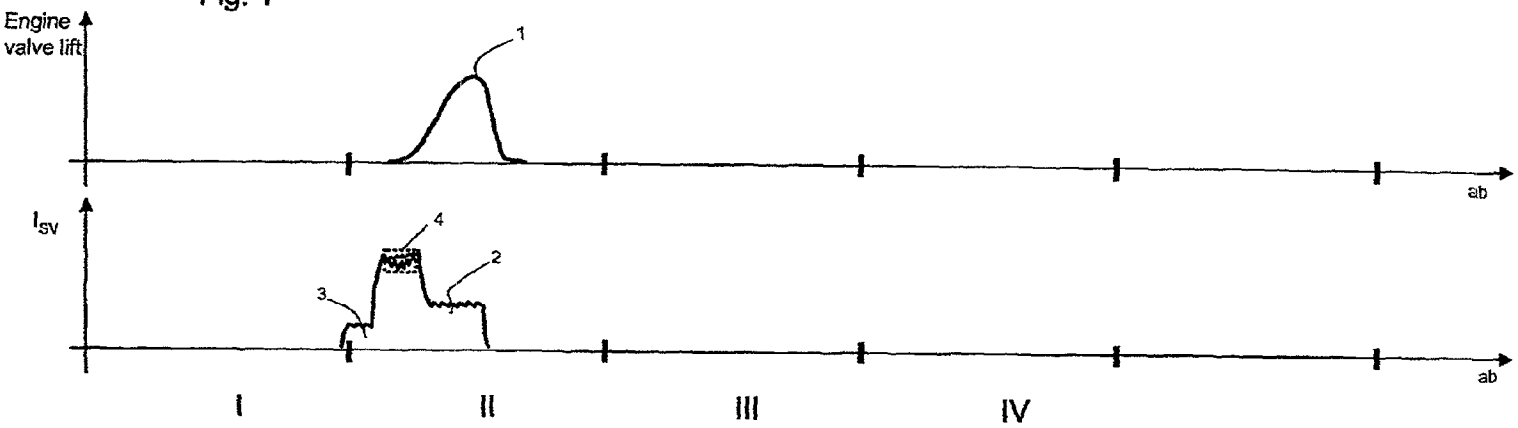
FIG. 1 shows in the upper graph the engine valve lift in dependence on the angular base, which is linked with time via the rotation speed of the camshaft.

In FIG. 1, the peak of the valve lift 1 corresponds to the lift of the gas valve during one engine cycle, which in total consists of the four engine phases, discharge I, intake II, compression III and expansion IV. Compression III and expansion IV are separated by the singular event of ignition.

The lower graph shows the Current ISV of the solenoid valve in dependence on the angular base with the three periods. The bias period 3, the hold period 2 and the peak period 4, which serves to distinguish a stuck solenoid valve 14 from an operable one.

Figure 2:
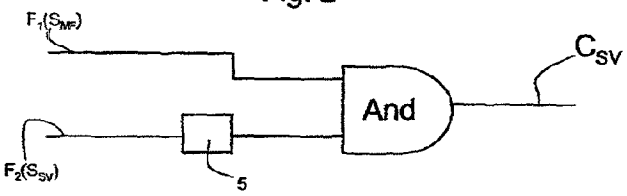
FIG. 2 shows an AND gate for comparing F(SMF) with F(SSV).
Figure 3:
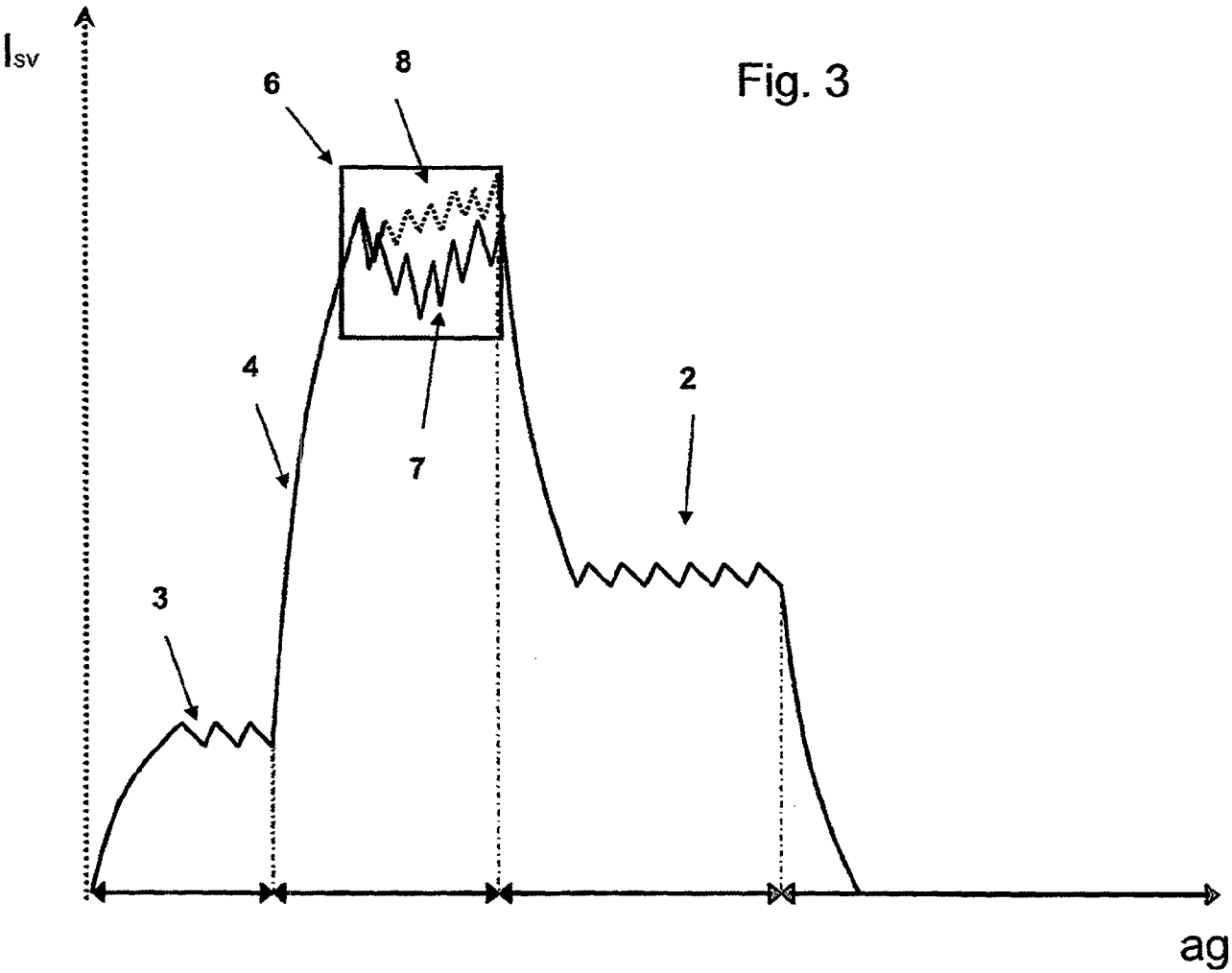
FIG. 3 shows the current characteristics in a preferred embodiment.

In FIG. 3 the current characteristics is shown in some more detail. The acquisition window 6 is used to focus the analysis on the peak period 4. The V-shape indicates the properly operating solenoid valve, whereas the flat shape 8 indicates the current response of a valve that is stuck. The control signal SSV could be, for example, be the Current ISV in the window 6. After some analysis and signal processing of SSV the secondary signal F(SSV) is generated to give, for example, the value 1 in case there is no V-shape 7 and the value 0 if there is. In a similar fashion F(SMF) can be generated to be compared with F(SSV) in an AND gate, as shown in FIG. 2. The outcome is the control output CSV, which would give a value of 1 if misfire and a stuck solenoid valve 14 was detected, too. Therefore the user can be sure that the solenoid valve 14 really got stuck and no other analysis needs to be performed. Furthermore analysis according to the invention generates the control output CSV within the engine cycle enabling a fast response by the control unit, such as a higher driving current for the stuck solenoid valve 14 or an interruption of the fuel injection.

In FIG. 4, Table 1 shows typical parameters and criteria for the status signal SSV analysis.

Figure 5:
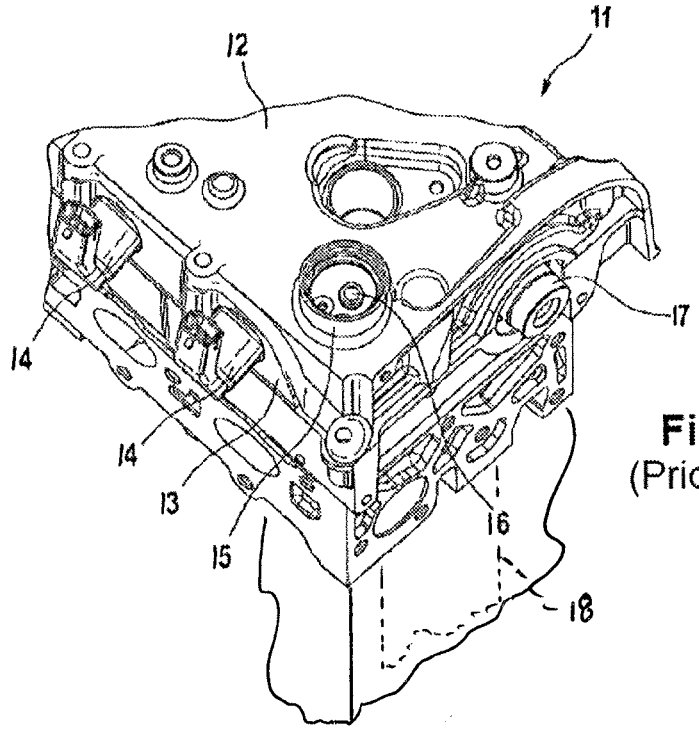
Fig. 5 (Prior Art)
FIG. 5 is a partial perspective view of a prior art cylinder head with an electro-hydraulically controlled gas exchange valve actuation system.
Figure 6:
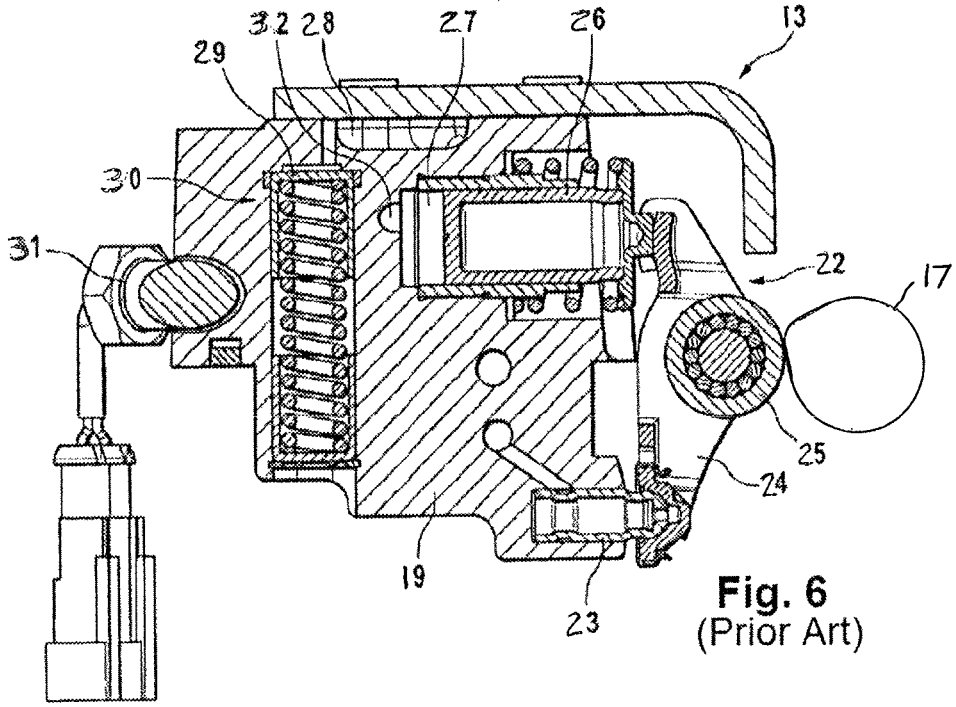
Fig. 6 (Prior Art)
FIG. 6 is a cross-sectional view according to the prior art showing a cylinder head with cam follower and cam arrangement for an electrohydraulic valve controller.
Figure 7:
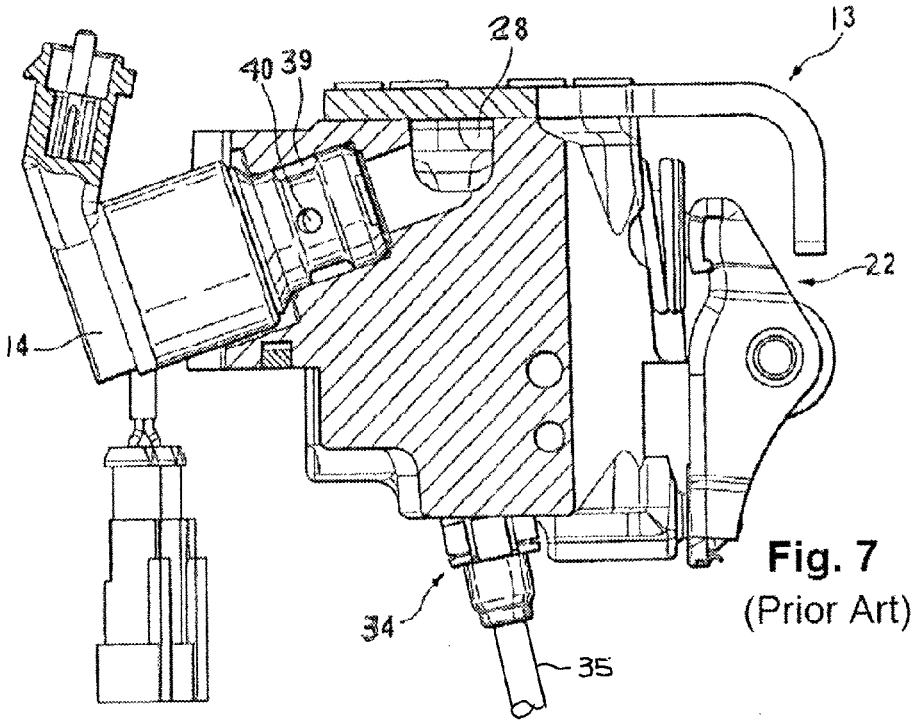
Fig. 7 (Prior Art)
FIG. 7 is a cross-sectional view through the cylinder head of FIG. 5 according to the prior art showing the solenoid valve for one of the gas exchange valves located in the cylinder head and the slave unit that drives the gas exchange valve.
Figure 8:
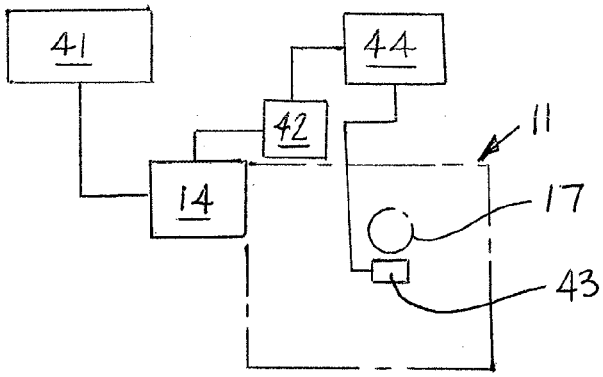
FIG. 8 is a schematic diagram of the operation control system according to the invention shown in connection with a solenoid valve.

In FIG. 8, the solenoid valve 14 that is adapted to hydraulically couple and decouple the actuation force of a cam 7 with a gas valve 35 of a cylinder in the combustion engine, all as shown in connection with FIGS. 5-7, are indicated schematically. The solenoid valve 14 opens to connect a high pressure chamber with another low pressure chamber and thereby reducing the pressure in the high pressure chamber in order to decouple the hydraulic actuation from the gas exchange valve 35. A driving unit, indicated schematically at 41, runs the solenoid valve, which may contain various driving and control circuits. A first detection device, indicated schematically at 42, monitors the status of the solenoid valve 14 by supplying a status signal to a control unit 44 during an engine intake cycle phase of the cylinder. This signal can be derived from a steering signal of the solenoid valve 14 or may be detected with a detector, such as an amp-meter or other electric current measuring device. A second detection device, indicated schematically at 43, analyzes a system parameter corresponding to the cylinder and supplying a control signal during an engine cycle phase other than the engine intake cycle phase. Such parameter might be a camshaft instantaneous angular velocity, which applies during the time the cylinder should have an effect on the crankshaft. Alternatively the ionization current in the combustion chamber could be measured and used as a control signal. Alternatively it is used to generate a secondary signal, which is a function of the control signal in order to condition the signal for further processing using the AND-comparison. The control unit 44 delays the status signal or a secondary status signal based on the status signal to temporally synchronize the status signal with the control signal or synchronize the secondary status signal with the secondary control signal, the secondary control signal being based on the control signal. Furthermore it compares the status signal with the control signal or the secondary signals with each other using an AND-Function.

REFERENCE NUMERALS AND LEGEND

| | | | |
|---|---|---|---|
| I | engine discharge phase | II | engine Intake phase |
| III | engine compression phase | IV | engine expansion phase |
| ab | angular base | CSV | control output |
| Isv | electric current of solenoid valve | SMF | control signal |
| SSV | status signal | F1(SMF) | secondary control signal |
| F2(SSV) | secondary status signal | | |
| 1 | engine valve lift | | |
| 2 | hold period | 3 | bias period |
| 4 | peak period | 5 | Delay |
| 6 | aquisition window | 7 | V-shape |
| 8 | flat shape | | |

The invention claimed is:

1. An operation control system for a solenoid valve of a combustion engine comprising:

at least one solenoid valve that hydraulically couples and decouples actuation forces of a cam with a gas valve of a cylinder in the combustion engine, a driving unit to operate the solenoid valve, a control unit, a first detection device monitoring a status of the solenoid valve that supplies a status signal to the control unit during an engine intake cycle phase of the cylinder, a second detection device configured to analyze a system parameter corresponding to the cylinder and supplying a control signal during an engine cycle phase other than the engine intake cycle phase, the control unit is configured to delay the status signal to temporally synchronize the status signal with the control signal, and compares the status signal with the control signal using an AND-Function.

2. The system as claimed in claim 1, wherein the control signal is generated during an engine cycle expansion phase of the cylinder.

3. The system as claimed in claim 1, wherein the delay is generated by an electronic component.

4. A method to control a solenoid valve of a combustion engine, comprising:

at least one solenoid valve hydraulically coupling and decoupling the actuation force of a cam with a gas valve of a cylinder in the combustion engine, a driving unit operating the solenoid valve, a first detection device monitoring a status of the solenoid valve by supplying a status signal to a control unit during an engine intake cycle phase of the cylinder, a second detection device analyzing a system parameter corresponding to the cylinder and supplying a control signal during an engine cycle phase other than the engine intake cycle phase, the control unit delaying the status signal to temporally synchronize the status signal with the control signal, comparing the status signal with the control signal using an AND-Function.

5. The system as claimed in claim 1, wherein the control signal is generated during an engine cycle discharge phase.

6. The system as claimed in claim 1, wherein the control signal is generated during an engine cycle compression phase.

7. The system as claimed in claim 1, wherein the delay is generated by a computer operation system running the control unit.

8. An operation control system for a solenoid valve of a combustion engine comprising:

at least one solenoid valve that hydraulically couples and decouples actuation forces of a cam with a gas valve of a cylinder in the combustion engine, a driving unit to operate the solenoid valve, a control unit, a first detection device monitoring a status of the solenoid valve that supplies a status signal to the control unit during an engine intake cycle phase of the cylinder, a second detection device configured to analyze a system parameter corresponding to the cylinder and supplying a control signal during an engine cycle phase other than the engine intake cycle phase, the control unit is configured to delay a secondary status signal based on the status signal to temporally synchronize the secondary status signal with a secondary control signal, the secondary control signal being based on the control signal, and compares the secondary signals with each other using an AND-Function.

* * * * *